United States Patent [19]

Winkler

[11] Patent Number: 4,899,078

[45] Date of Patent: Feb. 6, 1990

[54] THERMIONIC HAIRPIN CATHODE

[75] Inventor: Otto Winkler, Balzers, Liechtenstein

[73] Assignee: Balzers Aktiengesellschaft, Furstentum, Liechtenstein

[21] Appl. No.: 180,850

[22] Filed: Apr. 12, 1988

[30] Foreign Application Priority Data

Apr. 24, 1987 [CH] Switzerland ..... 01582/87

[51] Int. Cl.[4] ..... H01J 1/16

[52] U.S. Cl. ..... 313/37; 313/40; 313/264; 313/341

[58] Field of Search ..... 313/40, 37, 341, 336, 313/264

[56] References Cited

U.S. PATENT DOCUMENTS 3,279,042 10/1966 Fitzer et al. ..... 313/341 X 3,356,887 12/1967 Heil et al. ..... 313/336 X 4,473,771 9/1984 Chotsky et al. ..... 313/336

FOREIGN PATENT DOCUMENTS 1445695 8/1976 United Kingdom ..... 313/336

*Primary Examiner*—Palmer C. DeMeo

*Attorney, Agent, or Firm*—McGlew & Tuttle

[57] ABSTRACT

A thermionic hairpin cathode with a long operating life is made of a high melting metal wire, in which the temperature distribution along the legs is influenced either by locally increasing the radiation at a distance of 10 to 50% of the leg length from the crown or by decreasing the radiation in the immediate vicinity of the crown without changing the wire legs, possibly also by combining both measures, so that by increasing the temperature gradient in the crown region the maximum temperature is shifted close to or at the emission center.

17 Claims, 3 Drawing Sheets

THERMIONIC HAIRPIN CATHODE

FIELD AND BACKGROUND OF THE INVENTION

This invention relates in general to the construction of cathodes and in particular to a new and useful hairpin cathode which provides an electron source particularly for electron microscopes and similar electron-optical instruments.

Hairpin cathodes produced of wires of high-melting metals, in particular tungsten, are employed today in general as standard electron sources, for example, in electron microscopes and other electron-optical instruments.

Hairpin cathodes are used particularly in electron microscopes, in which a high beam value is required and, therefore, relatively high operating temperatures of 2700° to 2800° K are customary. Since the invention of the electron microscope the short operating life of the cathodes, which, as a rule, is only 20 to 50 hours, is a disturbing factor with which operators had to cope.

Intensive study of the factors, which influence the operating life of the cathode has shown, however, that possibilities exist of increasing the operating life, which have not been recognized and utilized so far, and the operating life can be increased several times without impairing the electronoptical properties.

The tungsten hairpin cathodes, which are applied today in electron microscopes, are manufactured of pure or thoriated tungsten wire of 0.12 to 0.14 mm diameter. The inner bending radius at the crown is most often 0.05 to 0.1 mm. This hairpin is connected at both of its leg ends by spot welding to the heating current feed lines in the cathode base. Both legs should be of such length, that the emitting crown point is at the same distance from the cold ends of the hairpin and, therefore, reaches the highest temperatures during operation. Therefore, the greatest removal of material through vaporization should also occur at this site and the operating life should be determined by the temperature and wire thickness at this site.

However, experience has shown that the cathode always melts next to the bend (see also FIG. 4). Hence a region next to the bend, apparently assumes higher temperatures than the emission center.

This can be observed, if a hairpin cathode is heated outside of the electron microscope in vacuo and the temperature distribution is observed with pyrometers over a period of time at constant crown temperature. Initially, no measurable temperature difference between the crown point and the immediately adjacent leg regions can be detected. Only after several hours can it be observed that one leg is noticeably hotter. The temperature difference subsequently becomes increasingly more pronounced until the wire melts thoroughly at the hottest site.

If it is recalled that at 2800° K a temperature increase by 10 K causes an increase of the vaporization rate by approximately 12%, it becomes clear, that even slight asymmetries in the temperature distribution can have catastrophic effects.

Examining the energy balance, which is given for each part of the wire by the Joule's heat supplied as the heat lost through radiation and heat conduction along the wire, offers an explanation. It is found that in the hairpin cathodes customary until now it is, for reasons of energy availability, not even possible that the expected temperature maximum occurs at the crown point. If one considers a short wire section in the region of the bend, the added radiation of the adjacent wire section toward the inside of the bend is less and its radiation toward the outside is greater than in the adjacent leg regions. Consequently, a temperature distribution obtains such as is shown in FIG. 1 by the solid line. Here, the temperature T over the distance d left and right from the crown point is plotted. Due to the good heat conductivity of tungsten, the temperature sink at the crown point is pyrometrically barely measurable. It amounts to only a few degrees. Precondition for the same level of temperature maxima to the left and right of the crown point is that the heat balance in the two legs is exactly symmetrical. If this is not the case, then an asymmetric temperature distribution originates as shown by the dotted line. This asymmetry becomes increasingly more pronounced over the course of time, and the resistance increase, through vaporization on the one side, becomes increasingly greater and also the removal on the other side through lowered temperatures decreases if the temperature at the crown point is kept constant. The temperature difference will, as the dot-dash line in FIG. 1 shows, increase to the point of, catastrophic thorough melting of a leg.

The asymmetry of the temperature distribution can have several causes:

1. uneven length of the two legs;
2. poor welding, i.e. poor heat transition of a leg to the current feed line;
3. poor electrical contact and heat transition at one of the contact pins of the cathode base;
4. inhomogeneities in the cathode material;
5. Thomson effect, which, as a consequence of the temperatures gradient in the two legs, and, depending on the current direction, leads to a heat supply in one leg and heat removal in the other.

This effect under normal operating conditions is not negligible, since the temperature difference caused by it can be 20 to 30° K.

These different causes can be additive with respect to their effect but can also completely or partially compensate each other. While causes 1 to 3 can be eliminated by careful manufacture of the cathodes and inhomogeneities in the cathode material are rare, the Thomson effect can only be eliminated through alternating current heating or through frequent polarity reversal of the current direction.,

SUMMARY OF THE INVENTION

The present invention increases the operating life of hairpin cathodes both by lowering the temperature sink at the crown point and, consequently, reducing the tendency toward destabilization of the temperature distribution, and also by decreasing the vaporization losses in this region through suitable measures.

An obvious measure for lowering the temperature sink or even avoiding it altogether, includes in decreasing the wire cross section at the bend so, that through increased local Joule's heat development a temperature increase is achieved. To do this, however, a considerable decrease of the cross sectional area is necessary, which, of course, has a negative effect on the operating life, so that nothing or not much is gained. This is especially true if the vacuum conditions are not optimal and additional removal through cathode sputtering must be taken into account.

In accordance with the invention, a thermionic hairpin cathode of a high-melting metal wire is provided which is characterized in that the temperature gradient near the crown point is increased through increased heat elimination along the two legs without decreasing the cross-sectional area of the wire.

According to a first form of the invention, the inventive goal is achieved in that the heat radiation at a distance from the crown point, which corresponds to 10 to 50% of the leg length, is locally increased by increasing the surface without significant decrease of the cross-sectional area of the wire.

According to a further preferred embodiment of the invention the wire in the regions of the two legs bordering on the crown point without having significant changes of the cross-sectional area of the wire is deformed so, that it has a semicircular profile with opposing flat sides which are at the minimum possible distance from each other.

Consequently, with the invention the temperature gradient along the legs starting at the crown point becomes significantly steeper. A temperature distribution then obtains as is shown in FIG. 2. The solid line shows the original temperature distribution under ideal conditions, and the dotted line the distribution after enlarging the surface at a site of the leg, which is approximately 2 mm away from the crown point. The overall length of the legs in this case was 8 mm.

In this manner it is also possible to move the site, or the sites having the higher temperature closer to the crown point or to shift it entirely to this point so that the operating life of the cathode is now determined solely by the wire thickness and the temperature at this site.

Enlarging the surface by approximately 0.7 $mm^2$ on each leg in this example, did, however, necessitate a heating current level increase by approximately 10%. It could, if necessary, be compensated for by a decrease of the wire thickness of 7%. The thereby caused decrease of the operating life, however, relative to the gain is hardly of any significance, because with this measure an extension by several times of the operating life of the hairpin cathodes employed until now can already be achieved.

An even longer operating life can be achieved, if the hairpin in the crown region can be deformed, or formed, in such a way, that the radiating and vaporizing surface is reduced while maintaining the cross-sectional area. This takes place, for example, in the way that with a stamping device the two legs in the region of the bend are approximated so closely that a semicircular-shaped wire profile results with the flat sides initially touching each other. The two legs are then spread again, so that the formed short-circuit is eliminated again, the distance, however, still is so small that the radiation and vaporization losses of these areas remain negligible.

In this manner likewise a greater temperature gradient along the two legs is created, so that the temperature maximum is moved closer to the tip. By the fact that simultaneously the vaporization losses are decreased by approximately 25%, a further increase of the operating life can be achieved.

Through the increase of the temperature gradient brought about by these measures, the effects of a potential unevenness of the leg lengths, the Thomson effect, and other effects are largely neutralized. They can now shift the temperature maximum only minimally away from the crown center.

Accordingly it is an object of the invention to provide a method of extending the life of thermionic hairpin cathode which has a pair of leg portions and a central crown portion connected to each leg portion, and which comprises selectively changing at least one either one or both of said leg portions and said crown portion to effect an increase of the difference of radiation between said crown portion and said leg portions.

A further object of the invention is to provide a method of increasing the operating life of a thermionic hairpin made of a high melting metal wire and which has a crown point interconnecting two leg portion and which comprises increasing the temperature gradient in the vicinity of the crown point by increasing heat elimination or dissipation along the two leg portions without a decrease of the cross-sectional area of the wire.

A further object of the invention is to provide a hairpin cathode construction which comprises a thermionic hairpin cathode metal wire having a pair of leg portions with a central crown portion interconnecting said leg portion which includes means on said hairpin which increases the radiation differences between said crown portion and said leg portions.

A further object of the invention is to provide a hairpin cathode which is simple in design, rugged in construction and economical to manufacture.

The various features of novelty which characterize the invention are pointed out with particularity in the claims annexed to and forming a part of this disclosure. For a better understanding of the invention, its operating advantages and specific objects obtained by its uses, reference is made to the accompanying drawings and descriptive matter in which preferred embodiments of the invention are illustrated.

DESCRIPTION OF THE PREFERRED EMBODIMENTS

Figure 1:
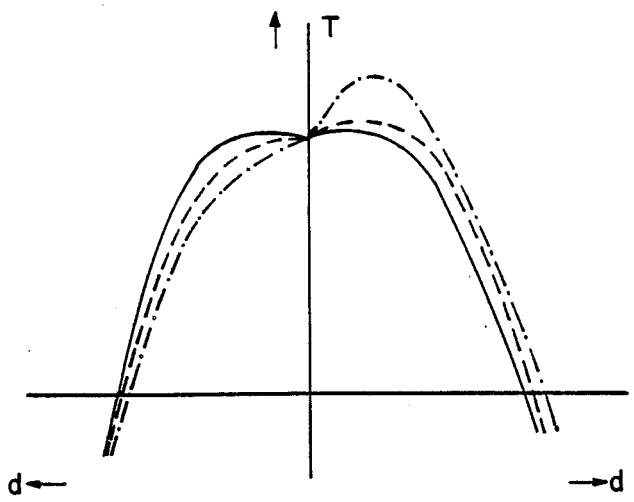
FIG. 1 is a curve showing a temperature distribution in a hairpin cathode between the crown and leg portions in respect to the distance of the leg portions away from the crown portion.
Figure 2:
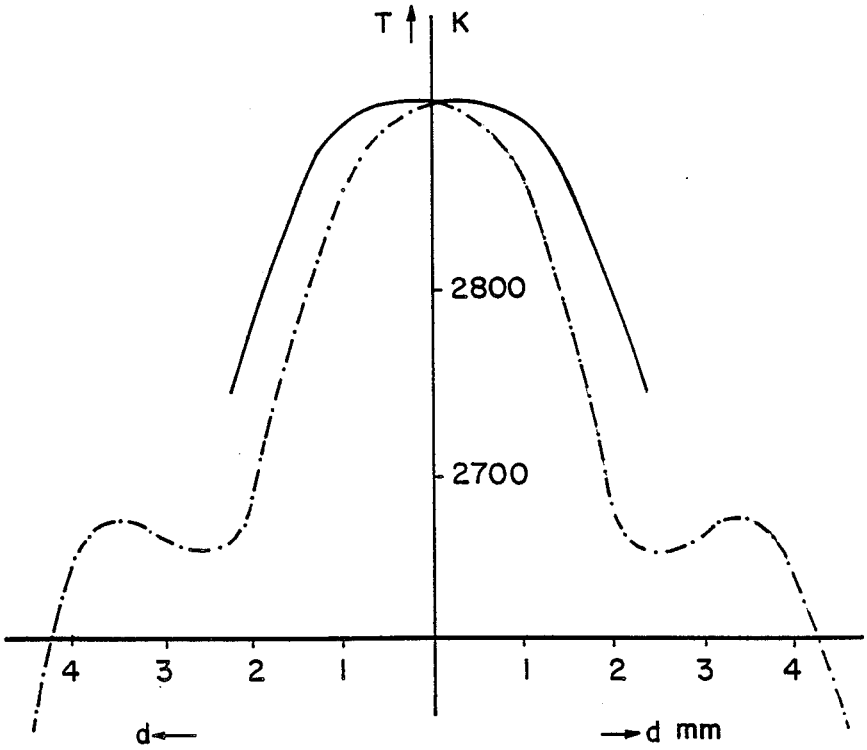
FIG. 2 is a view similar to FIG. 1 indicating how the cathode may be improved to increase its life in accordance with the invention.
Figure 3:
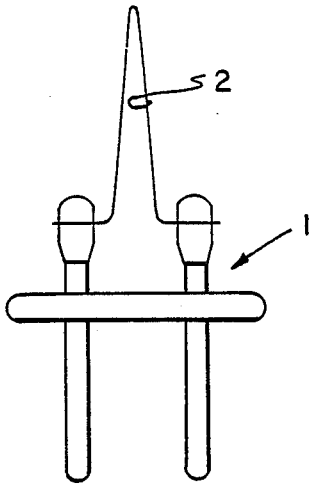
FIG. 3 is an elevational view of a hairpin cathode mounted on a cathode base in electron microscopes, on a scale of 4:1 and constructed in accordance with the invention.
Figure 4:
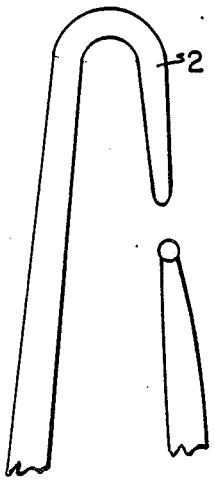
FIG. 4 (PRIOR ART)
FIG. 4 is an elevational view of a hairpin cathode of this form used until now in the region of the crown at the end of its operating life and shown in a scale of 50:1.
Figure 5:
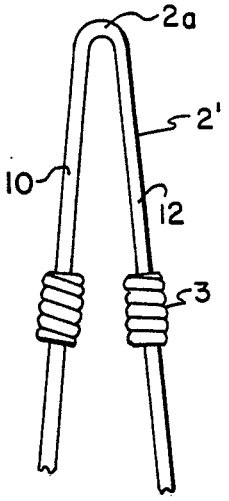
FIG. 5 is an elevational view of a hairpin cathode according to the invention in an embodiment of the invention with auxiliary bodies set onto it for locally increasing the radiation and which is on a scale of 20:1.
Figure 6:
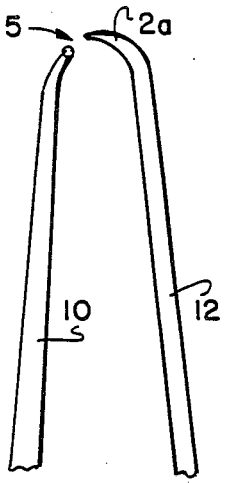
FIG. 6 is an elevational view of the crown region of a cathode at the end of its operating life at 2900° K operating temperature on a scale of 50:1.

Referring to the drawings in particular the invention embodied therein as shown in respect to drawings of FIG. 3, 5 and 6 comprises a hairpin cathode 2, 2, having leg portions 10 and 12 which are joined together by a central crown portion 1*a*.

In accordance with the invention means such as a wire winding 3 on each leg portion 10 and 12 are provided for increasing the radiation difference between the crown portion 2*a* and the leg portion 10 and/or 12.

Figure 10:
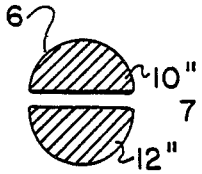

In accordance with the inventive method of extending the life of a thermionic hairpin cathode 2' which has a pair of leg portions 10 and 12 in a central crown portion 2*a* which joins the two leg portions together, comprises selectively changing at least one of said leg portions and said crown to effect an increase of the difference of radiation between the crown 2*a* and the leg portions 10 and 12. In the embodiment shown in FIG. 5, the wire winding 3 comprise such means and in another embodiment, such as the embodiments of FIGS. 7, 8 and 10, the wires are formed with portions such as the press areas 4 or the flat portions forming a gap 7 therebetween as shown in FIG. 10.

In the embodiment of hairpin cathode 2' according to FIG. 5 the local enlargement of the radiating surface is achieved by the fact that at a distance of approximately 2 mm from a crown point 2*a*, tungsten wire spirals 3 of approximately 0.6 mm length and 4.0 mm diameter are positioned on each leg 10 and 12. In order to achieve firm seating they are slightly pressed flat. After heating the cathode they connect with the wire core through diffusion welding and in this way receive the required good heat contact.

Through the increase of the radiating surface by approximately 0.7 $mm^2$ a temperature gradient starting at the crown point 2*a* of approximately 230° K originates at the crown point 2*a* at 2900 K; it is now twice as large as previously.

FIG. 6 shows the same cathode at the end of its operating life after 48 hours operation at a crown temperature of 2900° K. With this increased temperature the experimental time was to be shortened. It can be seen that it was possible to shift a site 5 of highest temperature close to the crown point and thereby to increase the operating life several times At the cathode temperature of approximately 2750° K. customary for normal use, the achieved operating life would be a 6 to 7-fold life increase, i.e. 300 to 350 hours instead of 20 to 50 hours, provided the temperature and the emission of the cathode is kept constant.

Figure 7:
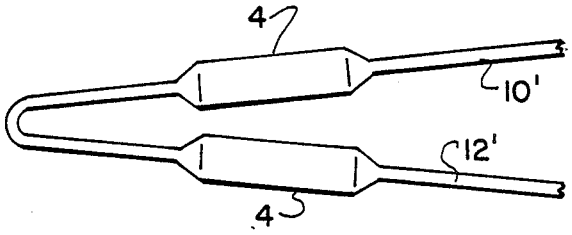
FIG. 7 is an elevational view of another embodiment of a hairpin cathode according to the invention with flat-pressed leg sections for locally increasing the radiation on a scale of 20:1.

In the embodiment according to FIG. 7, with which the same goal is striven for, local increase of the radiation is achieved by pressing the tungsten wire flat. Here, care must be taken not to have a minimum thickness of a flat-pressed region 4, since otherwise there is a danger that the percentage cross-sectional decrease per hour becomes greater there than at the crown, and, through excessive local resistance increase, the temperature gradient gradually disappears. In order to achieve nevertheless sufficient surface enlargement, the flat-pressed region must be longer than the wire spiral 3 in the first embodiment of FIG. 5. A suitable size is, for example, stamping to approximately 1.5 mm length with 0.4 mm width. This yields again, as in the previous example, a local surface enlargement of approximately 0.7 $mm^2$.

FIGS. 8 to 11 pertain to embodiments, in which the crown region of the hairpin cathode is deformed in a matrix at a temperature of 300 to 400° C. so, that the two legs 10" and 12" receive a semicircular-shaped profile 6, as is shown in FIG. 10. Stamping takes place to a length of 0.3 to 0.5 mm. The flat sides initially touch and would form a short-circuit if the legs subsequently were not slightly spread, so that a wedge-shaped gap 7 of 0 to 30 μm width originates. Through this gap the opposing surfaces can neither radiate to any significant degree nor can excessive quantities of material vaporize toward the outside. The radiation and vaporization losses of this cathode section are in this manner decreased by approximately 25%.

Unfortunately, this configuration can also have negative consequences if the temperature gradient is not great enough. Specifically, if the temperature of the opposing areas is different, one leg thickens at the expense of the other and if the temperature at the transition to the non-deformed part of the leg is not 20° to 30° K. lower than at the crown point, more material will vaporize there than in the stamped region and the cathode will melt thoroughly there. A steep temperature gradient is, therefore, in this embodiment particularly important.

Figure 8:
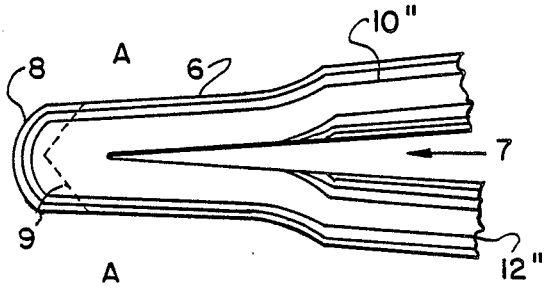
FIGS. 8, 9 and 10 stamped crown regions in further embodiments in respective front and side views on scales of 100:1, as well as a cross sectional view through this cathode taken along the line A—A of FIG. 8.
Figure 9:
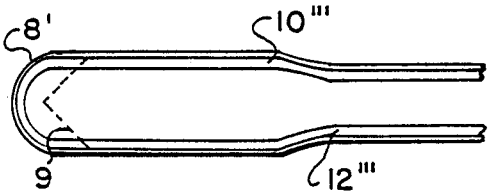

Stamping the legs carries with it a further important advantage. At the crown of the hairpin a approximately hemisphere-shaped cathode end 8,8' is created. The consequence is, that instead of an elliptical virtual shape of the emission surface, a circular shape is obtained, which with respect to electron optics is far more favorable. Onto the hemisphereshaped end 8',8 as shown in FIGS. 8 and 9, a cone or pyramidshaped end 9 can be ground, so that a pointed head cathode with long operating life is obtained. It eve contributes to an increase of the operating life if the relatively large material accumulation at the tip brought about by the stamping is in this manner, through its large radiation losses, reduced to the permissible mass and thereby the temperature gradient in the vicinity of the tip increased.

Figure 11:
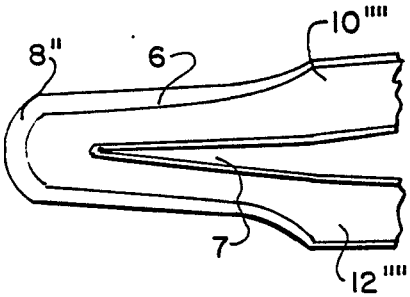
FIG. 11 is a view similar to FIG. 8 but which shows how the geometry of the cathode shown in FIG. 8 has changed after 50 hours of operation at 2900° K. The outlines of the starting state are also drawn in for comparison.

FIG. 11 shows a crown or head 8" geometry which is provided with additional cooling spirals like those in FIG. 5, however, without a ground tip, and is assumed after 50 hours of operating time at 2900° K. The operating life after this time has not yet reached its end and it would still be extended considerably if the generated asymmetry of the stamped leg regions would be more strongly suppressed by grinding a tip and increasing the temperature gradient.

If the hairpin cathode is produced with precise symmetry, the essential reason for the generated symmetry deviation is unquestionably the Thomson effect, which now becomes greater the more the temperature gradient is increased. A further gain of operating life can be achieved, if the influence of this effect were suppressed more strongly. Experiments by the inventor, in which the current direction was periodically changed, have proven this to be the case.

A suitable solution is that either the leg length is deliberately made differently or that the leg regions with increased radiation are arranged at different distance from the crown point or designed with different surface areas. This is done so that the geometry and current direction remain corresponding to each other. The connection sites of the current feed lines at the cathode base should be either appropriately marked or made so that they cannot be mistaken.

While specific embodiments of the invention have been shown and described in detail to illustrate the application of the principles of the invention, it will be understood that the invention may be embodied otherwise without departing from such principles.

What is claimed is:

1. A hairpin type cathode with longer lifetime especially for use in electron microscopes and other electron-optical instruments, comprising: a hairpin-shaped one piece high melting metal wire having a pair of diverging leg portions and a vertex portion interconnecting said leg portions, said vertex portion acting as a thermionic electron source and each of said leg portions having a connection end, the cross sectional area of the wire being substantially the same throughout said vertex portion and said leg portions, and each of said leg portions having a section of enlarged peripheral surface with respect to the peripheral surface of the vertex portion and of the other parts of the legs, said section of enlarged peripheral surface being short in relation to the leg portion length and being positioned between said vertex portion and said connecting end, so close to the vertex portion, that in operation due to the higher heat radiation losses at said section of enlarged peripheral surface, the temperature gradient adjacent said vertex portion is increased thereby causing a maximum temperature at the vertex portion during the entire lifetime of the cathode.

2. A hairpin type cathode according to claim 1, wherein the vertex portion of the wire has a substantial semicircular-shaped profile, the flat sides of the semicircular-shaped profile being detached by a wedge-shaped gap, the gap having a width which is smaller than the wire diameter, thereby in operation, the heat radiation losses at the mutually opposing flat sides of the semicircular-shaped profile of the vertex portion are lower than the heat radiation losses at the mutually opposing sides of the two leg portions.

3. A hairpin type cathode according to claim 1, wherein said sections of enlarged peripheral surface comprises flat-pressed wire sections of said leg portions.

4. A hairpin type cathode according to claim 1, wherein said sections of enlarged peripheral surface comprise wire sections with auxiliary bodies set onto said wire sections.

5. A hairpin type cathode according to claim 1, wherein said sections of enlarged peripheral surface are positioned a distance from the vertex portion of from 10 to 50% of the corresponding leg portion length.

6. A hairpin type cathode according to claim 1, wherein the two leg portions are of lengths which differ thereby compensating for the Thomson effect.

7. A hairpin type cathode according to claim 1, wherein the two sections of enlarged peripheral surface are positioned spaced at different distances from the vertex portion for compensation of the Thomson effect.

8. A hairpin type cathode according to claim 1, wherein the two sections of enlarged peripheral surface have different peripheral surfaces for compensation of the Thomson effect.

9. A hairpin type cathode with longer lifetime especially for use in electron microscopes and other electron-optical instruments, comprising: a hairpin-shaped one piece high melting metal wire having a pair of diverting leg portions and a vertex portion interconnecting said leg portions, said vertex portion acting as a thermionic electron source and each of said leg portions having a connection end, the cross-sectional area of the wire being substantially the same throughout said vertex portion and said leg portions, and the vertex portion of the wire having a substantial semicircular-shaped profile, the flat sides of the semicircular-shaped profile being detached by a wedge-shaped gap, the gap having a width which is smaller than the wire diameter, thereby, the heat radiation losses during operation, at the mutually opposing flat sides of the semicircular-shaped profile of the vertex portion is lower than the heat radiation losses at the mutually opposing sides of the two leg portions and therefore a maximum temperature at the vertex portion is achieved during the whole lifetime of the cathode.

10. A hairpin type cathode according to claim 9, wherein each of said leg portions has a section of enlarged peripheral surface with respect to the peripheral surface of the vertex portion and of the other parts of the legs, said section of enlarged peripheral surface being arranged such that in operation due to the higher heat radiation losses at said section the temperature gradient adjacent said vertex portion is increased.

11. A hairpin type cathode with longer lifetime especially for use in electron microscopes and other electron-optical instruments, comprising a hairpin-shaped one piece high melting metal wire having a pair of diverging leg portions and a vertex portion interconnecting said leg portions, said vertex portion acting as a thermionic electron source and each of said leg portions having a connection end, an auxiliary body welded onto each of said two leg portions for enlarging the peripheral heat radiation surface with respect to the peripheral surface of the vertex portion and thereby increasing the radiation difference between said vertex portion and said leg portions.

12. A hairpin type cathode according to claim 11, wherein the cross section area of the wire is substantially the same throughout said vertex portion and said leg portions.

13. A hairpin type cathode according to claim 11 or 12, wherein the vertex portion of the wire has a substantial semicircular-shaped profile, the flat sides of the semicircular-shaped profile being detached by a wedge-shaped gap, the gap width being smaller than the wire diameter, so that in operation the heat radiation losses at the mutually opposing flat sides of the semicircular-shaped profile of the vertex portion are lower than the heat radiation losses at the mutually opposing sides of the two leg portions.

14. A hairpin type cathode according to claim 11, wherein said auxiliary bodies are positioned at a distance of from 10 to 50% of the respective leg portion length from the vertex portion.

15. A hairpin type cathode according to claim 11, wherein the two leg portions have different length for the compensation of the Thomson effect.

16. A hairpin type cathode according to claim 11, wherein the two auxiliary bodies are positioned at different distances from the vertex portion for compensation of the Thomson effect.

17. A hairpin type cathode according to claim 11, wherein the two auxiliary bodies have different surface areas for compensation of the Thomson effect.

* * * * *